United States Patent [19]

Tomibe et al.

[11] 4,336,028

[45] Jun. 22, 1982

[54] METHOD OF MAKING ELECTRICALLY CONDUCTING FIBERS

[75] Inventors: Shinji Tomibe, Kyoto; Reizo Gomibuchi, Uji; Kiyofumi Takahashi, Yawata, all of Japan

[73] Assignee: Nihon Sanmo Dyeing Co., Ltd., Kyoto, Japan

[21] Appl. No.: 283,749

[22] Filed: Jul. 15, 1981

[30] Foreign Application Priority Data

Jul. 15, 1980 [JP] Japan ..... 55/97128

[51] Int. Cl.[3] ..... B05D 5/12

[52] U.S. Cl. ..... 8/624; 427/126.1; 427/443.1

[58] Field of Search ..... 427/126.1, 443.1; 8/624

[56] References Cited

U.S. PATENT DOCUMENTS

| | | | |
|---|---|---|---|
| 2,743,991 | 5/1956 | Schoonover et al. | 8/624 |
| 2,779,726 | 1/1957 | Rochester et al. | 8/624 |
| 3,014,818 | 12/1961 | Cambell | 428/365 |
| 3,416,874 | 12/1968 | Robin | 8/624 |
| 3,790,341 | 2/1974 | Makhkamov et al. | 8/624 |
| 3,940,533 | 2/1976 | Arsac | 428/389 |
| 4,122,143 | 10/1978 | Momotasi et al. | 264/104 |

FOREIGN PATENT DOCUMENTS 55-51873 4/1980 Japan .

*Primary Examiner*—Norman Morgenstern
*Assistant Examiner*—Richard Bueker
*Attorney, Agent, or Firm*—Armstrong, Nikaido, Marmelstein & Kubovcik

[57] ABSTRACT

A method of producing electrically conducting acrylic and acrylic-series fibers by treating the fibers in a treatment bath containing divalent copper ions, a reducing agent capable of reducing the divalent copper ions to monovalent copper ions and a sulfur-containing compound which provides sulfur which reacts with the monovalent copper ions to produce copper sulfide. The copper sulfide is adsorbed into the fiber and results in a fiber of superior conductivity and which posesses the touch and other physical characteristics of the starting fiber.

6 Claims, No Drawings

METHOD OF MAKING ELECTRICALLY CONDUCTING FIBERS

BACKGROUND OF THE INVENTION

1. Field of the Invention

This invention relates to a method of making electrically conducting acrylic and acrylic-series fibers.

2. Description of the Prior Art

Methods for imparting electrical conductivity to synthetic polymeric fibers are known in the art. These methods include, for example, the plating of the surface of fibers with a metal and the kneading of a metal into a polymer which is then spun into a yarn.

U.S. Pat. Nos. 3,014,818 and 4,122,143 disclose methods of producing electrically conductive products by the reduction of a copper compound to metallic copper. In U.S. Pat. No. 3,014,818, an electrically conductive fibrous material is produced by soaking the fiber, such as cotton or acrylic fibers, in a bath comprising a reducible salt of nickel, cobalt, copper or iron. The fiber is then subjected to a reducing treatment to obtain free metal particles which are dispersed through the interior of the fiber. Sodium borohydride and hydroxylamine are disclosed as satisfactory reducing agents. According to U.S. Pat. No. 4,122,143, cured products are obtained by reducing copper simultaneously with the curing of a resin. The imparting of electrical conductivity to an existing fiber is not disclosed.

These methods suffer from various disadvantages including the requirement of complicated treatment processes, the requirement of high-grade techniques of manufacture and the obtaining of fibers which do not have good color, touch and other physical characteristics.

The present inventors developed a method for producing electrically conductive acrylic and acrylic-series fibers which avoids the disadvantages of the prior art methods. The acrylic or acrylic-series fibers are heat-treated in a bath containing monovalent copper ions so that the fibers adsorb the monovalent copper ions. The fibers are then heat-treated with a sulfur-containing compound to convert the adsorbed monovalent copper ions into cuprous sulfide or cupric sulfide. This 2-step process results in electrically conducting fibers having superior conductivity which is not lost in repeated washings. The touch and other physical characteristics of the starting acrylic fibers are preserved in the process and the electrically conductive fibers can be dyed by cationic dyes. This 2-step method is described and claimed in copending U.S. patent application, Ser. No. 183,639.

It is an object of the present invention to simplify the 2-step (2-bath) method for producing electrically conducting acrylic and acrylic-series fibers while, at the same time, retaining the superior electrical conductivity, hue, touch, washability, dyeing power and other physical properties of the fibers.

SUMMARY OF THE INVENTION

According to the present invention, electrically conducting fibers are obtained by treating acrylic or acrylic-series fibers, including modacrylic fibers, in a bath containing divalent copper ions, a reducing agent capable of reducing said divalent copper ions to monovalent copper ions and a sulfur-containing compound which is capable of reacting with the monovalent copper ions to produce cuprous sulfide or cupric sulfide. The present invention thus provides a one-step, or one-bath, treatment for obtaining electrically conductive acrylic or acrylic-series fibers having superior conductivity and outstanding physical properties.

DETAILED DESCRIPTION OF THE INVENTION

In the process of the present invention, the acrylic or acrylic-series fibers, including modacrylic fibers, are treated in a bath containing divalent copper ions and a reducing agent capable of reducing the divalent copper ions to monovalent copper ions. The divalent copper ions are provided in the bath by the use of cupric compounds such as cupric sulfate, cupric chloride, cupric nitrate and the like. Suitable agents for reducing the divalent copper ions to monovalent copper ions in the bath are metallic copper, ferrous sulfate, ammonium vanadate, sodium hypophosphite, hydroxylamine sulfate, furfural, glucose, and the like.

The bath for treating the acrylic and acrylic-series fibers according to the process of the present invention also contains a sulfur-containing compound which provides sulfur atoms and/or sulfur ions for reacting with the monovalent copper ions to produce cuprous sulfide or cupric sulfide. Suitable sulfur-containing compounds include sodium sulfide, dithionous acid, sodium dithionite, sodium thiosulfate, sulfurous acid, sodium hydrogen sulfite, sodium pyrosulfite, thiourea dioxide, Rongalite C ($NaHSO_2.CH_2O.2H_2O$), Rongalite Z ($ZnSO_2.CH_2O.H_2O$), and the like. Furthermore, sulfur dioxide or hydrogen sulfide can be bubbled into the bath to provide the sulfur for reacting with the monovalent copper ions.

Mixtures of the various individual components of the bath may be employed.

The bath can optionally contain an acid or a salt for adjusting the pH of the bath. Suitable acids and salts for this purpose are inorganic acids such as sulfuric acid or hydrochloric acid, organic acids such as citric acid or acetic acid and salts thereof or a combination of an acid and a salt such as citric acid and disodium hydrogen phosphate.

The temperature of the treatment bath is preferably within the range of 40° to 120° C. under normal conditions. At higher treatment temperatures, the strength of the fibers are liable to deteriorate although the time of treatment will be shorter. At lower temperatures, the time of treatment may be undesirably long.

With respect to the quantity of copper sulfide to be adsorbed by the fibers, satisfactory electrical conductivity properties cannot be obtained at very low contents. However, if the quantity is too high, physical properties such as hue and the like will be degraded. In the practice of the present invention, the amount of copper sulfide to be adsorbed in the fibers should be from 1 to 30% by weight (expressed in terms of the weight of metallic copper) based upon the weight of the starting fiber.

Electrically conducting fibers obtained according to the method of the present invention analyzed by the use of X-ray diffraction techniques show the presence of digenite (empirical formula: $Cu_9S_5$) which demonstrates that copper sulfide is dispersed in the fiber.

The electrically conducting fibers obtained according to the method of the present invention, as compared to electrically conducting fibers obtained by the metal plating method of the prior art, are excellent in electric conductivity and washability. This is believed to be due to the fact that the copper sulfide is dispersed within the fiber as opposed to being concentrated on the surface of the fiber. The touch and other physical properties of the original fibers are preserved and thus the fibers can be employed in the same manner as the original acrylic or acrylic-series fibers.

Furthermore, the electrically conducting fibers obtained according to the present invention have a hue that is light-colored as compared to fibers obtained according to a conventional metal plating method and thus can be dyed as desired with various kinds of dyes, particularly with cationic dyes. Typically, the electrically conducting fibers obtained according to the present invention are dyed in an aqueous solution containing a cationic dye at a temperature of about 100° C. for about 30 minutes to one hour.

The electrically conducting fibers obtained by the method of the present invention can be employed in various fields requiring dyed fibers. The fibers may be combined with non-conductive synthetic fibers to provide excellent control over the electrical properties of knitted or woven goods. A small amount of the electrically conductive fibers of the present invention can be mingled into knitted or woven goods in the form of filament fibers. Also, spun yarns can be produced from mixtures of the electrically conductive fibers obtained according to the present invention with other synthetic fibers which are both in the form of staple fibers.

The method according to the present invention may be better understood by referring to the following examples in which all parts, percentages, and proportions are by weight unless otherwise indicated.

EXAMPLE 1

Cashmilon (acrylic fiber, 2 deniers, 51 mm in length of cut, type FWBR, made by Asahi Chemical Industry Co., Ltd., Japan) first was thoroughly scoured and then was heat-treated in a bath containing 30 wt.% of cupric sulfate, 15 wt.% of sodium thiosulfate, and 15 wt.% of sodium hydrogen sulfite in relation to the weight of the fiber in the bath. The weight ratio of the fiber to the water containing the chemicals was 1:15 (1 part of the fiber weight to 15 parts of water weight containing chemicals) for 60 minutes at a temperature of 75° C. to which the temperature had been raised gradually from room temperature. The fiber was washed with water and left to dry.

The Cashmilon fiber thus obtained had an olive green color and an electrical resistivity of $3.6\times10^{-2}$ Ω·cm. When this Cashmilon fiber was analyzed by the use of X-ray diffraction analysis, lines of diffraction (interfacial distance: 1.97 Å, 3.21 Å, 2.79 Å) of digenite (empirical formula: $Cu_9S_5$) were perceived. The amount of copper sulfide contained in the fiber was 14.2% in relation to the weight of the starting fiber.

After this electrically conducting Cashmilon fiber was subjected to a repeated washing test ten times according to Japanese Industrial Standards (JIS) L-1405, A-2, its electrical resistivity was $4.3\times10^{-2}$ Ω·cm. In tese tests, the electrical resistivity increased very little, and it was ascertained that its washability also was good.

Further, when this electrically conducting Cashmilon fiber was treated in a 2 wt.% aqueous solution of Sumiacryl Brilliant Red N-4G (cationic dye, made by Sumitomo Chemical Industry Co., Ltd., Japan) at a temperature of 100° C. for 30 minutes, it was dyed dark red and the electric conductivity was not lowered.

EXAMPLE 2

Kaneboacryl (acrylic fiber, 3 deniers, 51 mm in length of cut, type BR VO-1, made by Kanebo Synthetic Fiber Co., Ltd., Japan) first was thoroughly scoured and then was heat-treated in a bath containing 20 wt.% of cupric sulfate, 10 wt.% of sodium pyrosulfite and 10 wt.% of hydroxylamine sulfate in relation to the weight of the fiber in the bath. The fiber to bath ratio was 1:15 (1 part of the fiber weight to 15 parts of water weight containing the chemicals). The heat-treatment was carried out for 120 minutes at a temperature of 50° C. to which the temperature had been raised gradually from room temperature. The fiber was washed with water and left to dry.

The Kaneboacryl fiber thus obtained has an olive green color, and had an electrical resistivity of $5.8\times10^{-2}$ Ω·cm. When the fiber was analyzed by the use of X-ray diffraction analysis as in Example 1, the lines of diffraction of digenite were perceived therein. The amount of copper sulfide contained in the fiber was 13.8% in relation to the weight of the fiber.

The electrical resistivity of the fiber, after the washing test had been carried out thereupon as in Example 1, was $6.3\times10^{-2}$ Ω·cm, and its washability also was good.

As in Example 1, when this electrically conducting Kaneboacryl fiber was treated in an aqueous solution of Diacryl Navy Blue RL-N (cationic dye, made by Mitsubishi Chemical Industry Co., Ltd., Japan), it was dyed brilliantly in navy blue, without lowering the electric conductivity.

EXAMPLE 3

Kanekalon S (acrylic series fiber, 2 deniers, 51 mm in length of a cut, made by Kanegafuchi Chemical Co., Ltd., Japan) first was thoroughly scoured and then was heat-treated in a bath containing 20 wt.% of cupric sulfate, 80 wt.% of copper net (No. 31, 12 mesh), 10 wt.% of sodium thiosulfate, and 5 wt.% of sulfuric acid in relation to the weight of the fiber in a fiber to bath ratio of 1:15 (1 part of the fiber weight to 15 parts of water weight containing the chemicals) for 60 minutes at a temperature of 100° C. to which the temperature had been raised from room temperature. It was then washed in water and left to dry.

The Kanekalon S fiber obtained by the treatment described above had an olive green color and an electrical resistivity of 1.3 Ω·cm. The X-ray diffraction analysis revealed the existence of lines of diffraction of digenite, as in Example 1. The amount of copper sulfide contained in this fiber was 9.2% in relation to the weight of the fiber.

The electrical resistivity of this fiber, after the washing test had been carried out thereupon as in Example 1, was 1.4 Ω·cm, and its washability also was good.

As in Example 1, when this electrically conducting Kanekalon S fiber was treated in the aqueous solution of Diacryl Brilliant Blue $H_2R$—N (cationic dye, made by Mitsubishi Chemical Industry Co., Ltd., Japan), it was dyed a brilliant dark blue, without lowering the electric conductivity.

Although the present invention has been described with respect to certain preferred embodiments thereof, it is not intended to be limited to these embodiments but includes all of those embodiments within the scope and spirit of the following claims.

What is claimed is:

1. A method of making an electrically conducting fiber comprising treating an acrylic fiber or modacrylic fiber in a bath containing divalent copper ions, a reducing agent capable of reducing said copper ions to monovalent copper ions and a sulfur-containing compound to convert said monovalent copper ions to copper sulfide wherein said fiber adsorbs copper sulfide.

2. A method as claimed in claim 1 wherein said divalent copper ions are provided by at least one cupric compound selected from the group consisting of cupric sulfate, cupric chloride and cupric nitrate.

3. A method as claimed in claim 1 wherein said reducing agent is at least one member selected from the group consisting of metallic copper, ferrous sulfate, ammonium vanadate, sodium hypophosphite, hydroxylamine sulfate, furfural and glucose.

4. A method as claimed in claim 1 wherein the sulfur-containing compound is at least one member selected from the group consisting of sodium sulfide, dithionous acid, sodium dithionite, sodium thiosulfate, sulfurous acid, sodium hydrogen sulfite, sodium pyrosulfite, thiourea dioxide, Rongalite C, Rongalite Z, sulfur dioxide and hydrogen sulfide.

5. A method as claimed in any one of claims 1, 2, 3 and 4 wherein the treatment is carried out at a temperature at from 40° and 120° C.

6. A method as claimed in claim 5 wherein the electrically conducting fiber obtained in the treatment is dyed with a cationic dye.

* * * * *